United States Patent [19]

Lee et al.

[11] 4,393,534

[45] Jul. 19, 1983

[54] FLOOR CLEANING AND POLISHING MACHINE

[75] Inventors: Jeffrey A. Lee, Crystal; Mike J. Todd, Eagan, both of Minn.

[73] Assignee: H. B. Fuller Company, Saint Paul, Minn.

[21] Appl. No.: 310,000

[22] Filed: Oct. 9, 1981

[51] Int. Cl.[3] ..... A47L 11/162

[52] U.S. Cl. ..... 15/98; 15/49 R; 51/177; 74/366

[58] Field of Search ..... 15/28, 29, 49 R, 50 R, 15/98, 385; 51/177, 134.5; 74/325, 329, 366, 369

[56] References Cited

U.S. PATENT DOCUMENTS 3,178,956 4/1965 Stanley ..... 74/369

FOREIGN PATENT DOCUMENTS 766034 1/1957 United Kingdom ..... 15/49 R

*Primary Examiner*—Edward L. Roberts

*Attorney, Agent, or Firm*—Merchant & Gould

[57] ABSTRACT

The subject to this patent application is apparatus for mechanically varying the speed of a disk, such as a floor treating pad (18), mounted for rotation about the axis of elongation (20) of a shaft (38) powered by a fixed speed motor. The pad (18) is supported by a hub (40) disposed axially intermediate a flange member (74) fixedly attached to the shaft (38) and a sheave (66) disposed for rotation about the shaft (38), but at a speed different than that of the shaft (38). The invention includes means for keying the hub (40) to either the flange member (74) or the sheave (66), depending upon the desired speed of operation of the floor treating machine (10) of which the pad (18) is a part.

15 Claims, 6 Drawing Figures

FLOOR CLEANING AND POLISHING MACHINE

TECHNICAL FIELD

The invention of the present application is directed broadly to the field of machines for cleaning, polishing, and burnishing tile-type floor surfaces, and particularly such floors in commercial or industrial establishments. More specifically, however, the invention is related to apparatus for mechanically altering the speed of the buffing pad or brush used with such machines.

BACKGROUND OF THE INVENTION

In order to assist in keeping various types of commercial and industrial establishments clean and neat in appearance, and particularly in keeping the floor clean and polished, various functions are performed thereon. Floor maintenance jobs which are performed include scrubbing, spot-cleaning, stripping, spray buffing, polishing, shampooing, and, in some circumstances, even sanding. Various types of devices have been designed to accomplish these functions. The typical floor treating machine known in the art has a rotating pad including a treating surface which moves in a generally horizontal plane. In the majority of instances, these machines are electrically operated, having a motor to impart rotation to the treating pad and a power cable which can be plugged into a conventional electrical wall outlet to provide a source of power for the motor.

Depending upon the function and application to which the machine is to be put, it is desirable that the machine possess a feature whereby the speed at which the treating pad rotates can be varied. Low speed machines are desirable for scrubbing floors, applying wax finishes to floors, stripping wax build-up from floors, and sanding or polishing floors. High speed machines are desirable for effecting final polishing or burnishing floors. Floor surfaces can, thereby, be brought to a high luster to provide a desirable appearance and ease of maintenance.

In order to effect the lower speed functions, it is desirable that the treating pad be made to rotate at 150–225 rotations per minute, in order to effect higher speed functions, it is desirable that the treating pad be made to rotate at 900–1200 rotations per minute. In machines known in the art, speed ranges are typically changed by varying the speed of the motor. The means by which this is accomplished typically include electrical devices intergral with the circuitry of the motor. Frequently, a switching mechanism is used to effectuate the speed range change. The switching mechanism can be changed by a toggle or similar switch mounted proximate the handle of the machine.

Even when using such speed change means, however, the desirable ranges of approximately 200 rotations per minute and 1200 rotations per minute cannot be accomplished within the same machine. This is due, in a significant part, because of the limitations inherent in electrical motors. In floor treating machines wherein change of speed of rotation of the treating pad is effected by changing the speed of the motor, therefore, the speed range is typically limited to a low speed range (approximately 200 rotations per minute) and a medium speed range (varying between 300–500 rotations per minute).

Even if the desirable speed ranges were obtainable, machines wherein the speed of the motor is varied have other limitations. By varying the speed of the motor, the horsepower output varies commensurately. Consequently, although such a machine may operate at an optimum efficiency at one of its speeds, something less than maximum efficiency is achieved at its other speed.

It is to these limitations and problems in the prior art that the invention of the present application is directed. It provides apparatus wherein speed of the machine can be varied between a low speed range (approximately 200 rotations per minute) and a high speed range (approximately 1200 rotations per minute), and wherein the speed variation is accomplished by mechanical means without the power output of the machine fluctuating.

SUMMARY OF THE INVENTION

The invention of the present application is an apparatus for varying the speed of a disk such as a floor polishing pad component of a floor treating machine. The apparatus is mechanical in nature, thereby allowing the speed variation without any change in horsepower output being effected as might occur in machines wherein the speed is varied by varying the motor speed. The disk is disposed for rotation about an axis, typically vertical, and the invention includes means by which the disk is supported relative to the axis for such rotation. A power source, such as a fixed speed motor, serves as the source of rotary motion. The apparatus includes structure whereby the rotary motion can be transmitted directly from the power source to the disk support, and, in turn, the disk, with minimal variation from the fixed speed of the power source. The invention further includes an element which is mounted for rotation about the axis about which the disk support rotates. This element is made to rotate at a speed other than that of the fixed speed of the power source. The variant speed is effected by gearing the element to a different speed, but off of the direct output from the power source. Finally, the invention includes structure for keying the disk support to either the variant speed element or directly to an output from the power source. The keying is accomplished selectively by the user of the machine with which the variable speed apparatus is used. The speed selected is a function of the application to which the machine is to be put.

In one embodiment of the invention, the variant speed element can comprise a substantially annular sheave which is geared down from the fixed speed of the power source. The take off from the power source can comprise a shaft which has an axis of elongation coinciding with the axis about which the disk support rotates. The sheave can be support about the shaft by a bearing having inner and outer races so that the sheave, although closely adjacent the shaft, can rotate at a speed different therefrom.

The disc supporting means can comprise a hub mounted for rotation about the shaft and axially intermediate the sheave and a generally radially extending annular flange fixedly attached to the shaft at an end thereof remote from the power source. The flange is made to rotate at the speed of the shaft, and, in turn, the fixed speed of the power source. The hub can be selectively keyed to either the sheave or the generally annular flange. This can be accomplished by providing each of the hub and the flange with one of a first pair of holes which are able to be brought into registration with one another, and each of the hub and the sheave with one a second pair of holes which are able to be brought into registration with one another. A pin can be provided and selectively inserted through either the first pair of holes when in registration, or the second pair of holes when in registration. With the pin inserted within the first pair of holes, the hub is keyed to the flange and rotates at the fixed speed of the power source. With the pin inserted into the second pair of holes, the hub is keyed to the sheave and rotates at a speed different from the fixed speed of the power source (normally a speed reduced from that of the power source).

The gearing down of the speed of the shaft to that of the sheave can be accomplished by a pulley arrangement. A first pulley can be mounted to the shaft and keyed for rotation therewith. Second and third pulleys, fixedly mated to one another for joint rotation, are disposed for rotation about a second axis. The second pulley is axially coextensive with the first pulley, and a first endless belt extends about the outer peripheral surfaces of the first and second pulleys so that the rotation of the shaft can be transmitted to the second pulley. By structuring the second pulley so that it has a diameter larger than that of the first pulley, the second pulley/third pulley assembly will rotate at a speed slower than that of the shaft.

The third pulley is made axially coextensive with the sheave, and a second endless belt extends about the outer peripheral surfaces of said third pulley and said sheave. The third pulley can be given a diameter smaller than that of the sheave so that a second stage speed reduction from the speed of the rotating shaft can be effected.

The invention of the present application is, thus, an improved floor cleaning and polishing machine utilizing mechanical means to effect speed variation from the speed of a constant speed power source. Many of the problems in the prior art are, thereby, overcome. More specific advantages of the invention will become apparant with reference to the drawings, detailed description of the invention, and appended claims.

DESCRIPTION OF THE INVENTION

Figure 1:
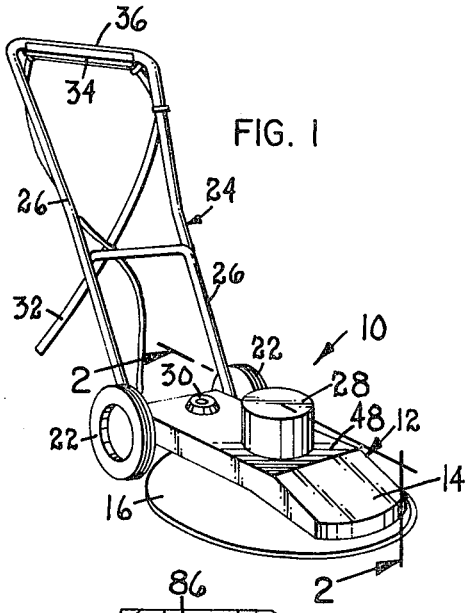
FIG. 1 is a view, in perspective, of a multispeed floor cleaning and polishing machine embodying the mechanical speed varying apparatus of the present invention.

Referring now to the Drawings wherein like reference numerals denote like elements throughout the several views, FIG. 1 illustrates a floor treating machine 10 in which speed variation apparatus in accordance with the claims of the present application can be used. Typically, such a machine 10 includes a housing 12 having a main longitudinal portion 14 from which a cowling 16 is suspended. The cowling 16, in most machines, is circular and extends somewhat beyond the treating pad or brush 18 disposed beneath the housing 12 for engagement with the floor and rotation about a generally vertically extending axis 20.

Figure 2:
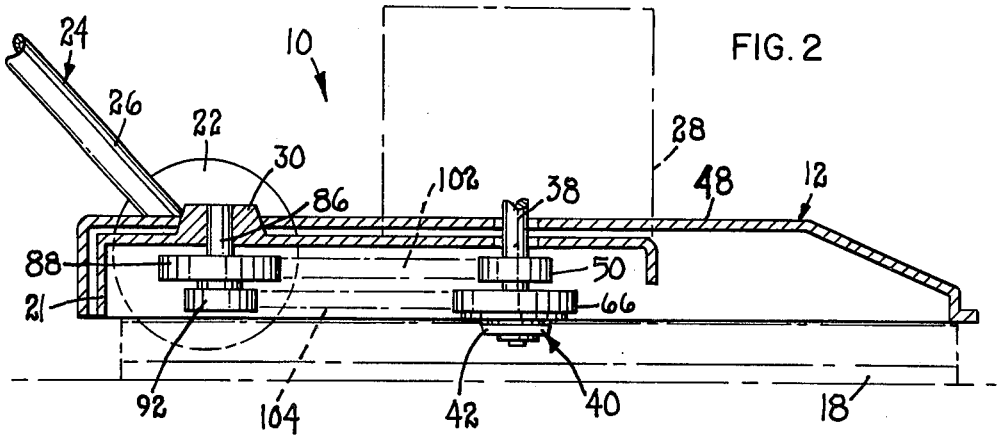
FIG. 2 is a view taken generally along the line 2—2 of FIG. 1.
Figure 5:
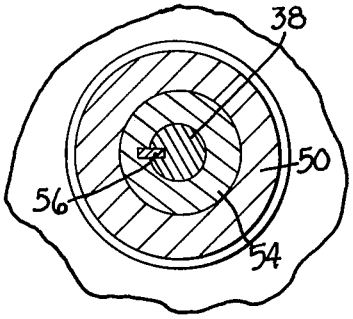
FIG. 5 is a figure taken generally along the line 5—5 of FIG. 3.

The housing 12 is carried by a structural frame 21 which is disposed below housing 12. Two similarly sized transporting wheels 22 are mounted to frame 21 for rotation about a common axis. Wheels 22 are retractable to an elevated disposition, as seen in FIG. 2, so that full pad 18 engagement with a floor surface being treated can be effected.

A handle member 24 is provided to enable the operator to maneuver the machine 10. Although a handle member having two arms 26 extending upwardly and rearwardly from the housing 12 is illustrated in FIG. 1, it will be understood, of course, that other types of handles are known in the art, and other types of handles might function equally as well to enable the machine 10 to be maneuvered.

A motor 28 is mounted to the longitudinally extending portion 14 of the housing 12 and can be covered by a hood (not shown). The motor 28 is shown, in FIG. 1, as being generally circularly cylindrical.

An annular rim 30 is shown protruding through the longitudinal portion 14 of the housing 12 rearwardly of the motor 28. This rim 30 will be discussed more specifically hereinafter.

An electrical power cable 32 is shown as extending from the housing 12 and has a remote end which carries a conventional two or three prong plug for insertion into an electrical outlet. The cable 32 serves to provide electrical energy to the motor power source 28.

The machine 10 can include a "dead man" lever 34 attached to a generally horizontally extending portion 36 of the handle 24. Such a lever 34 functions as a switch to activate the motor source. The lever 34 is biased to an open position so that, if the handle 24 is inadvertently released by the operator of the machine 10, electrical energy will be precluded from activating the motor. It will be understood that actuation means and deadman mechanisms other than those specifically described above are specifically contemplated for use with the invention.

Figure 6:
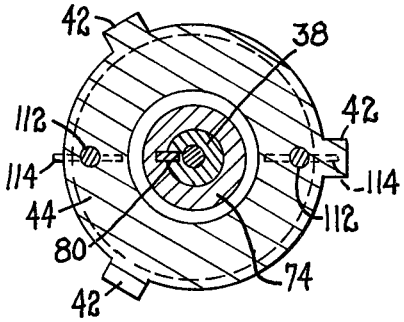
FIG. 6 is a figure taken generally along the line 6—6 of FIG. 4.

Referring now to FIG. 2, a disk-like floor treating pad 18 is mounted for rotation about a shaft 38 extending downwardly from the motor 28 and through the housing 12 and the frame 21. The disk 18 is supported, with respect to the shaft 38, by a hub member 40. As best seen in FIG. 6, the hub 40 can include three lugs 42 spaced angularly about a central core 44 at 120° from one another. The treating pad 18 can have a central mounting plate which includes an apperture with a diameter similar to that of the hub's core 44 formed therein. The plate can have cut-outs spaced and sized similarly to the lugs 42 of the hub 40 so that the pad 18 can be raised upwardly around the hub 40 with the lugs 42 riding through the cut-outs. When the plate is above the upper surfaces of the lugs 42, the pad 18 can be rotated in a direction opposite the direction of rotation of the hub 40 during operation of the machine 10 until the lugs 42 engage vanes (not shown) extending downwardly from the plate. When the machine 10 is actuated with the hub 40 rotating in its operational direction, engagement of the vanes by the lugs 42 will cause the pad 18 to be rotated in the desired operational direction.

Figure 3:
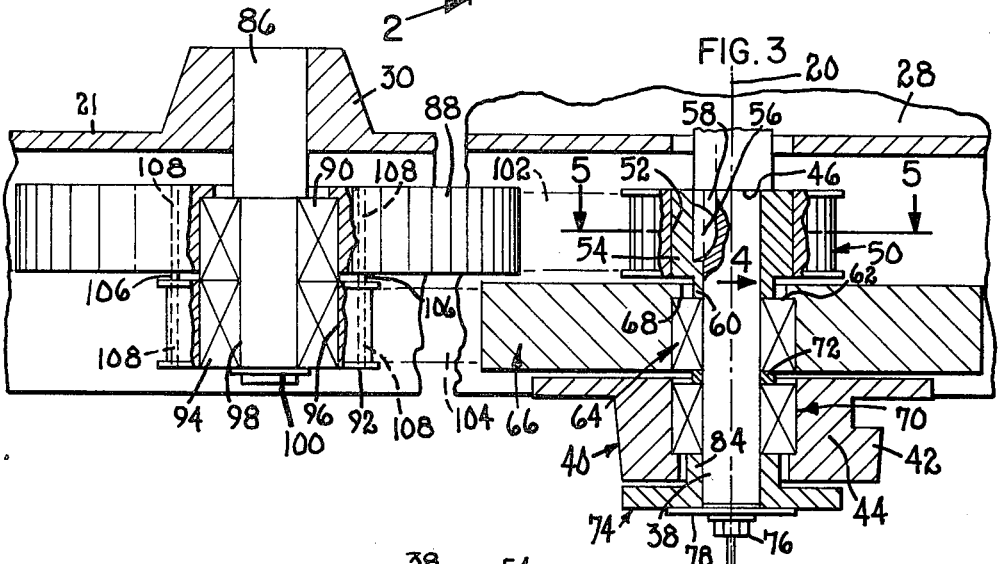
FIG. 3 is an enlarged view, in section, illustrating the means by which the speed of a shaft driven by the constant speed power source is geared down to a reduced speed, some elements being omitted for purposes of clarity.
Figure 4:
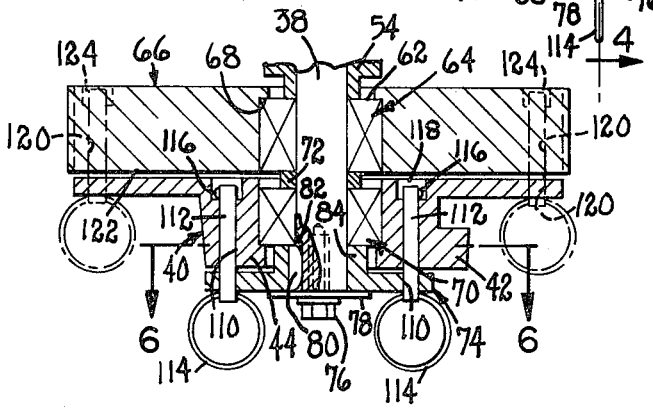
FIG. 4 is a view taken generally along the line 4—4 of FIG. 3.

Referring now to FIGS. 3 and 4 of the Drawings, the stub shaft 38 extending down from the motor is illustrated as carrying a number of rotatably mounted members in addition to the hub 40. The shaft 38 has an axis of elongation coinciding with an axis 20 about which the rotatably mounted elements move.

As illustrated in FIG. 3, a shoulder 46 is formed in shaft 38. Shoulder 46 is below an upper wall 48 of the housing 12 and frame 21 and axially engages an insert 54 press fit into a first pulley 50 attached to the shaft 38 for rotation therewith. Such axial engagement precludes movement of pulley 50 upwardly along shaft 38. An inner surface 52 of the pulley 50 frictionally engages insert 54 which has a key 56 fitting into a first keyway 58 formed in the shaft 38. The keyway 58 is shown in FIG. 3 as extending downwardly from the upper end of the shaft 38. It will be understood that the keyway 58 can extend either upwardly or downwardly along the shaft 38.

The insert 54 is shown as having an extension 60 projecting downwardly and engaging the upper surface 62 of the inner race of a bearing 64. The bearing 64 has inner and outer races so that a sheave 66 radially engaging the outer race can rotate at a speed independent of the speed of rotation of the shaft 38. The sheave 66 has a shoulder 68 axially engaging the upper surface 62 of the outer race of the bearing 64 to preclude downward movement of the sheave 66.

The bearing 64 supporting the sheave 66 is spaced axially from a bearing 70 supporting the hub 40 by a short spacer element 72. The bearing 70 supporting the hub 40, like that supporting the sheave 66, has inner and outer races which enable the hub 40 to rotate at a speed different from that of the shaft 38.

The shaft 38 carries, at its lower end, a generally annular flange member 74. The flange member 74, in addition to serving other functions, serves to hold all of the elements mounted for rotation about the longitudinally extending axis 20 of the shaft 38, to the shaft 38. It is held to the shaft 38 by a bolt 76/washer 78 arrangement as seen in FIG. 4. The flange 74 includes a key 80 alignable in a keyway 82 formed in the lower end of the peripheral wall of the shaft 38 so that, as the shaft 38 rotates, the flange 74 will rotate at the same speed.

The flange 74 includes an axially extending sleeve portion 84 which engages the bottom surface of the inner race of the bearing 70 to close all of the axially aligned members together. The sleeve portion 84 engages only the inner race of the bearing 70 so as to not preclude rotation of the hub 40 independently of the shaft 38. The sleeve portion 84 of the flange 74 additionally functions to carry the key 80.

As previously indicated, a dual race bearing 64 is interposed radially between the rotating shaft 38 and the sheave 66. Consequently, the sheave 66 is free to rotate at a speed different that that of the shaft 38. The invention provides means for gearing the sheave 66 from the shaft 38 to a speed variant from the speed of the shaft 38. In a preferred embodiment, the gearing means can include a second shaft 86 pressfit into the annular rim 30 formed in the structural frame 21 and extending through the upper wall 48 of the housing 12. Because of the friction fit of the second shaft 86 with the rim 30, the second shaft 86 will not rotate.

This shaft 86 also carries a number of components for rotation about its generally vertically extending axis of elongation. A second pulley 88 is carried upwardly along the shaft 86 proximate the upper wall of the structural frame 21. A dual race bearing 90 is interposed radially intermediate the pulley 88 and the shaft 86 so that the pulley 88 is able to rotate relative thereto.

A third pulley 92 is positioned axially below the second pulley 88. The third pulley 92 also has a dual race bearing 94 radially inwardly therefrom, wherein the outer race engages the radially inner surface 96 of the pulley 92, and the inner race engages the outer surface 98 of the shaft 86. Respective inner and outer races of the bearings 90, 94 supporting the second and third pulleys 88, 92 engage each other axially. The second pulley/third pulley assembly is maintained on the second shaft by a retaining ring 100.

As best seen in FIGS. 2 and 3, the first and second pulleys 50, 88 are axially coextensive. That is, their upper surfaces and lower surfaces, respectively, are coplanar. A first endless belt 102 shown in phantom extends about the outer peripheral surfaces of these pulleys 50, 88 in order to transmit the rotational motion of the first pulley 50 about the axis 20 of elongation of the stub shaft 38 to the second pulley 88. In one embodiment, each of these pulleys 50, 88 can have outer peripheral surfaces having a multiplicity of axially extending grooves formed therein. The inner surface of the belt 102 extending around these pulleys 50, 88 can have a multiplicity of tongues formed therein which, when the belt 102 is engaged with the outer peripheral surfaces of the pulleys 50, 88, mesh with the grooves in order to maximize efficiency of transmission.

As seen in the Figures, the diameter of the second pulley 88 is greater than that of the first 50. Since the pulleys 50, 88 are annular, it follows that the circumference of the second pulley 88 is greater than that of the first 50 also. Consequently, the angular speed of the second pulley 88 will be less than that of the first 50. Thus a first stage of speed reduction will be effectuated during the transmission of rotational motion from the first pulley 50 to the second 88.

In order to transmit the rotational motion of the second pulley 88 to the annular sheave 66 mounted for rotation about the axis 20 of the stub shaft 38, the third pulley 92 is made axially coextensive with the sheave 66 and is keyed to the second pulley 88. A second endless belt 104, having the features of the first belt 102, is made to extend about the outer peripheral surfaces of the third pulley 92 and the sheave 66. A second stage speed reduction is effectuated by giving the third pulley 92 a diameter, and circumference, smaller than those of the sheave 66.

It is essential, of course, in order to transmit the rotational movement of the second pulley 88 to the sheave 66, that the third pulley 92 be keyed to the second pulley 88. As seen in FIG. 3, this can be accomplished by providing at least one pin 106 which can be inserted through registrable holes 108 formed in the second and third pulleys 88, 92. As seen in FIG. 3, two pins 106, spaced generally at 180° from one another, can be utilized in order to strengthen the transmissional linkage between the second and third pulleys 88, 92. It will be understood by those of skill in the art that keying can be accomplished in other manners, however. An alternative method of keying would be to unitarily manufacture the second and third pulleys 88, 92. Being a single structure, the third pulley portion would rotate as did the second pulley portion.

As can be seen, then, because of the two stage speed reduction effected during the transmission of rotational motion from the first pulley 50 to the second pulley 88, to the third pulley 92, and to the sheave 66, the sheave 66 will rotate at a speed less than that of the stub shaft 38. The invention includes means for imparting either the fixed speed rotational motion of the stub shaft 38 directly to the hub 40 or the reduced speed rotational motion of the sheave 66, as geared down, to the hub 40. The fixed speed of the stub shaft 38 can be transmitted to the hub 40 by providing at least one pair of registrable holes 110, a first of each pair being formed in the annular flange 74 and the second of each pair being formed in the hub 40. By bringing the registrable holes 110 into alignment, a pin 112 can be inserted to key the flange 74 and hub 40 together. The pin 112 can include a pull ring 114 attached at its accessible end and a retractable detent 116 formed in its inserted end. The detent 116 can be biased to its extended position so that it will be received within a recess 118 in the hub 40 when the pin 112 is inserted. As in the case of keying the third pulley 92 to the second pulley 88, keying of the hub 40 to the flange 74 can be accomplished by the use of two pins 112.

In order to disengage the hub 40 from the flange 74, the pins 112 can be pulled so that the force biasing the detents 116 is overcome, and the pins 112 can, thereafter, be retracted from the registered holes 110.

Similar holes 120 can be provided in the hub 40 to register with mates formed in a platen surface 122 facing downwardly from the sheave 66. If it is desired to operate the floor treating machine 10 at a lower speed, the pins 112 can be inserted into these second pairs of registrable holes 120 so that the hub 40 will rotate with the sheave 66 rather than the shaft 38 and its annular flange 74. The sheave 66 can include recesses 124 to receive the detents 116 of the pins 112 when the pins 112 are inserted into the second pairs of registered holes 120 in order to preclude inadvertent withdrawal of the pins 112 and disengagement of the hub 40.

It will be understood that, although in the preferred embodiment illustrated in the Figures the sizing of the pulleys 50, 88, 92 and sheave 66 is to accomplish a reduction in speed from that of the motor, the speed of sheave 66 could be stepped up from the motor speed by reversing the relative sizes of the circumferences of the first and second pulleys 50, 88 and third pulley 92 and sheave 66, respectively. Although speed might be gained in such an embodiment, however, efficiency might be lost.

Numerous characteristics and advantages of the invention have been set forth in the foregoing description. It will be understood, however, that this disclosure is only illustrative in many respects and that changes may be made in details, particularly in matters of shape, size, and arrangement of parts without exceeding the scope of the invention. The invention's scope is defined in the language in which the appended claims are expressed.

What is claimed is:

1. Apparatus for mechanically varying the speed of a disk driven rotationally about an axis by a power source, comprising:

(a) means for supporting the disk relative to the axis, said supporting means being rotatably disposed about the axis;

(b) means for imparting rotational motion to said supporting means directly from the power source and at a fixed speed;

(c) a variant speed element mounted for rotation about the axis and geared from the power source to a different speed;

(d) means for selectively keying said supporting means to one of said direct rotational motion imparting means and said variant speed element.

2. Apparatus in accordance with claim 1 wherein said variant speed element is geared down from the fixed speed of the power source.

3. Apparatus in accordance with claim 1 wherein said direct rotational motion imparting means comprises a shaft having a generally vertical axis of elongation, said axis of elongation coinciding with the axis about which the disk is driven, and wherein said supporting means comprises a hub concentric to said shaft.

4. Apparatus in accordance with claim 3 wherein said selective keying means comprises a generally annular flange member fixedly keyed to said shaft.

5. Apparatus in accordance with claim 4 wherein said variant speed element comprises a substantially annular member having a platen surface facing said hub.

6. Apparatus in accordance with claim 5 wherein said flange member and said platen surface member axially straddle said hub, and wherein said selective keying means comprises said hub and said flange member each have one of a first pair of registrable holes formed therein and said hub and said platen surface member each have one of a second pair of registrable holes formed therein.

7. Apparatus in accordance with claim 6 wherein said selective keying means comprises a pin selectively insertable through one of: said first pair of holes, when in registration, and said second pair of holes, when in registration; whereby, when said pin is inserted through said first pair of holes, said hub will rotate at the fixed speed of the power source, and, when said pin is inserted through said second pair of holes, said hub will rotate at the different geared speed.

8. A two-speed floor treating machine, comprising:

(a) a housing disposed for movement over a floor surface;

(b) a shaft, having a generally vertically extending axis of elongation, extending below said housing;

(c) fixed speed power means for imparting rotational movement to said shaft about said axis;

(d) means for supporting a floor treating pad for rotation about said axis;

(e) a varient speed element mounted for rotation about said axis and at a speed different than that of said power means;

(f) means for gearing said shaft to said variant speed element; and (g) means for selectively keying said supporting means to one of said shaft and said variant speed element.

9. A floor treating machine in accordance with claim 8 wherein said shaft has a lower end remote from said housing and wherein said selective keying means comprises a generally annular flange member, said shaft carries said flange member, keyed to said shaft, proximate said lower end.

10. A floor treating machine in accordance with claim 9 wherein said variant speed element comprises a sheave mounted to said shaft for rotation thereabout independent of shaft rotation.

11. A floor treating machine in accordance with claim 10 wherein said supporting means comprises a hub axially intermediate said flange member and said sheave.

12. A floor treating machine in accordance with claim 11 wherein said selective keying means comprises said hub and said flange member each having one of a first pair of registrable holes formed therein and said hub and said sheave each have one of a second pair of registrable holes formed therein, and a pin selectively insertable through one of said first pair of holes, when in registration, and said second pair of holes, when in registration.

13. A floor treating machine in accordance with claim 10 wherein said gearing means comprises said sheave, a first pulley, coaxial with said sheave, mounted and keyed to said shaft, and second and third pulleys, keyed together for joint rotation about a second axis spaced from, and generally parallel to, said axis of said shaft, said first and second pulleys being axially coextensive and being operatively connected by a first endless belt extending from said first pulley to said second pulley, and said third pulley and said sheave being axially coextensive and being operatively connected by a second endless belt extending from said third pulley to said sheave.

14. A floor treating machine in accordance with claim 13 wherein said sheave has a diameter greater than that of said third pulley and said second pulley has a diameter greater than that of said first pulley.

15. A floor treating machine in accordance with claim 14 wherein each of said sheave and said first, second, and third pulleys has an outer peripheral surface with a multiplicity of axially extending grooves formed therein, and wherein each of said belts has an inner surface having a multiplicity of tongues meshable with said grooves formed therein.

* * * * *